US007556236B2

(12) United States Patent
Slappay

(10) Patent No.: US 7,556,236 B2
(45) Date of Patent: Jul. 7, 2009

(54) INDIVIDUAL ICE CUBE HANDLING DEVICE

(76) Inventor: Robert Slappay, 238 Rockaway Tpke, Cedarhurst, NY (US) 11516

( * ) Notice: Subject to any disclaimer, the term of this patent is extended or adjusted under 35 U.S.C. 154(b) by 0 days.

(21) Appl. No.: 11/894,296

(22) Filed: Aug. 21, 2007

(65) Prior Publication Data

US 2009/0050784 A1 Feb. 26, 2009

(51) Int. Cl.
*F25C 1/24* (2006.01)

(52) U.S. Cl. ..... 249/66.1; 249/67; 249/119; 249/124; D15/90

(58) Field of Classification Search ..... 249/66.1, 249/67, 119, 122, 124, 127; D15/90
See application file for complete search history.

(56) References Cited

U.S. PATENT DOCUMENTS 1,753,940 A * 4/1930 Reed ..... 249/122
2,537,915 A * 1/1951 Roop ..... 249/122
3,685,785 A * 8/1972 Brown ..... 249/129
4,366,941 A 1/1983 Harris
4,412,429 A 11/1983 Kohl
4,899,976 A 2/1990 Cederroth et al.
5,364,063 A 11/1994 Nishimura et al.
6,168,131 B1 1/2001 Tabatabaie
6,209,849 B1 4/2001 Dickmeyer
6,345,802 B2 2/2002 Moore
2006/0097127 A1* 5/2006 Firth ..... 249/205

* cited by examiner

*Primary Examiner*—James Mackey
(74) *Attorney, Agent, or Firm*—Richard L. Strauss, Esq.

(57) ABSTRACT

An individual ice cube handling device is disclosed comprising an ice tray and a decorative flag. The ice tray includes a plurality of compartments having a retaining collar formed therein located at a central, inferior position of each compartment. A staff portion of a decorative flag coaxially engages the retaining collar so that, when water is added to the compartments and frozen therein, the decorative flag extends beyond the superior surface of each frozen cube so as to provide a means of removing individual ice cubes from the tray, a means of hygienically handling the cubes, and a means of displaying a decorative or informative banner. The staff is shaped and configured as a tapered rod so as to facilitate removal of the decorative flag from the ice when desired.

15 Claims, 6 Drawing Sheets

INDIVIDUAL ICE CUBE HANDLING DEVICE

TECHNICAL FIELD

The present invention relates to the art of ice cube tray design as well as apparatus utilized to extract, carry and deliver cubes made therein. The present invention also relates to the field of decorative food and beverage accessories.

BACKGROUND OF THE ART

Manually operated ice cube trays are well known to the art. Such trays are often utilized in, for example, freezers and refrigerator/freezer devices as an adjunct to automated ice makers or as the sole means of producing ice cubes. In the past, such trays were commonly fabricated of metallic materials such as aluminum, stainless steel etc. Such metallic trays often included individual cube shaped compartments that would be filled with water, placed in a freezer and allowed to stand until the water had fully hardened into individual ice cubes. Thereafter, in order to release the ice cubes therefrom, the bottom of such trays might be warmed with, for example, relatively warm water or other forms of heat. Other such trays included extraction devices which would, for example, enable walls of each cube forming compartment to be biased so as to physically eject the ice cubes. Simple sheering force might also be utilized to release ice cubes from metal trays wherein sharp tapping of the tray with or against a hard object would release the cubes.

More recently, flexible plastic ice trays have been widely utilized to manually form ice cubes. Such trays also often contained individual compartments wherein water was placed prior to placing the tray in a, for example, freezer. When the water in such trays had fully hardened into ice, such trays could be, by virtue of the flexible plastic from which they were made, be twisted in order to distort the individual ice cube compartments and force the ice cubes therefrom. With both metallic and plastic ice trays, it has heretofore been somewhat difficult to remove only one or a selected few cubes from the trays in which they were formed utilizing the above methods.

Upon releasing ice cubes from either metallic or plastic ice trays, the resulting ice might, for example, thereafter be placed in an ice bucket or open ice bowl to enable service of the ice therein to individuals desiring same. In order to remove the ice cubes form the bowls or buckets, one commonly utilized a large spoon, tong, or in some instances, one's fingers. Problematic of such methods, ice cubes are, by nature, slippery and are often dropped during spoon and, to a somewhat lesser extent, tong handling. Removing ice from a container with one's hand is, of course, wrought with dangers related to transmission of bacterial and viral infections.

To date, there has not been disclosed a simple and effective means of removing a selected cube or cubes from a manually operated ice tray without disturbing the remaining ice. There has also been no disclosure of an effective and efficient means of handling individual ice cubes without the use of spoons, tongs, or direct manual handling of ice.

SUMMARY OF THE INVENTION

Now, in accordance with the present invention, a method and apparatus is disclosed enabling individual ice cubes to be removed from a tray in which they are formed as well as carried to a point of use without the need for conventional spoons, ice tongs or manual handling of the ice. The present invention also provides a means of displaying decorative, informative and festive flags while also providing the aforementioned functions.

Now in accordance with the first embodiment of the present invention, an individual ice cube handling apparatus is disclosed comprised of an ice cube tray, ice cube staff and decorative flag.

The ice cube tray may be configured, for example, as a rectangular cube having a top surface, front wall, a back wall, two end walls and a bottom surface. However, the tray may be configured in any desired shape as long as it includes an open top surface into which water may be poured and ice removed, and closed side walls and bottom so that it can contain such water and ice. In all such embodiments of the present invention the top portion of the tray is configured so as to form a plurality of compartments which are open at a top portion only, and otherwise closed (in regard to side or bottom surface(s)) so as to enable the compartments to contain water (as explained in more detail, below). The compartments may be configured in any desired shape such, as for example, a standard "cube" shape. However, the compartments may also be configured in more unusual and decorative shapes such as, for example, pyramidal shapes. However, regardless of the shape selected, the compartments must be configured so as to avoid the inclusion of undercuts which would, of course, prevent water, which has frozen within the compartments, from being drawn upwards, through the open top of the compartment. More specifically, sidewalls of such compartments must either be roughly parallel or diverge from one another as they approach the top of the tray so that ice cubes formed therein will draw from the compartments. If, for example, the compartments are configured in a pyramidal shape, the apex of the pyramid must be located downward and at the lowest point of the compartment, pointing away from the top portion of the ice tray.

The compartments are especially configured and formed to include a staff retaining collar as an integral part thereof. The collar is advantageously formed and positioned, at the lowest, (most inferior) portion of the compartment, and in a central location. For example, if, once again, a pyramidal shaped compartment is utilized, the retaining collar will be located at the apex thereof since such would be the central point of the most inferior portion of the compartment. If, for example, the compartment is configured as a square shaped receptacle, then the retaining collar would be located in the center of the square shaped wall forming a bottom wall (or, as it may also be referred to, bottom surface or floor) of the compartment.

It is highly advantageous to form the retaining collar as an integral part of each compartment formed within and upon the surface of the compartments so as to be water tight and to enable coupling of a flag staff (or as it may also be referred "an ice cube staff") with each compartment and, as described below, center such a staff within the confines of ice which forms within each compartment. More specifically, the retainer collar is so located and configured so as to enable, as described below, secure and centralized positioning of the staff prior and after filling of the ice tray with water and so that, upon formation of each cube, the staff will be positioned centrally therewithin and so a portion of the staff will extend beyond the upper surface of the frozen ice so as to provide a "handle" extending therefrom. For this purpose, the retaining collar includes an open superior terminus which is contiguous with a central bore therewithin especially shaped and configured to mate with an inferior portion of the flag staff. The handle formed by the staff provides a means for "handling" the ice without the need for manually contacting it, a means for extracting ice from individual compartments of the tray, and also a site for placement of a decorative banner.

The ice cube tray may be advantageously fabricated from a relatively flexible material enabling the tray to be manually deformed (as discussed below), as a means of removing frozen ice therefrom. Such deformable material, or, as it may also be referred to as—a flexible material—includes, for example, polyacrylic, polycarbonate, polyester, polynitrile, polypropylene, polystyrene, polyvinyl plastics. materials. The tray may also be advantageously fabricated from other flexible materials such as, for example, natural rubber compounds, silicone rubber, polyurethane rubber, as well as other synthetic rubbers.

In preferred embodiments of the present invention, the ice cube staff is advantageously shaped and configured as a tapered rod having an inferior and superior terminus. More specifically, the staff is configured so that the diameter thereof increases from a minimal diameter adjacent to the inferior terminus thereof to a maximum diameter adjacent to the superior terminus thereof. The inferior terminus of the staff is closed and especially shaped and configured to enable coaxial insertion thereof within a central bore of the above described retaining collar. In certain preferred embodiments of the present invention, a portion of the staff, which is located adjacent to the interior terminus thereof and configured/shaped for insertion within the retaining collar, comprises a straight rod-like section of the staff—exhibiting parallel, rather than tapering walls—. Such parallel configuration, in combination with similarly non-tapered walls forming the central bore of the retaining collar, provide a more secure engagement of the inferior portion of the staff within the collar. However, the remainder of the staff, superior to that portion of the staff, which is inserted within the collar, advantageously is shaped as a tapered rod exhibiting its greatest diameter at the superior terminus thereof, and its most diminutive diameter proximal to the inferior terminus of the staff. In certain preferred embodiments of the present invention, the superior terminus of the staff is open and exposes a bore therewithin especially shaped and configured to firmly engage and retain a mast of the decorative flag described below.

As described above, the ice cube staff is fitted within and engages the retaining collar of an ice cube compartment prior to filling same with water. Thereafter, the compartments are filled with water and the tray is placed in a freezer, for example, in order to enable the water therein to freeze into cubes. When the water has thoroughly frozen, the ice cubes may be individually removed from the tray by applying a lateral, biasing force to that portion of the staff which extends from the top of each ice cube desired. However, one may also remove the ice cubes from the tray via the conventional means. For example, in embodiments of the present invention wherein the trays are formed of a flexible plastic material, the tray may be twisted so as to release the cubes. A tapping force may also be utilized, with or without the use of warm water, to gently warm the bottom of the tray. If the tray is fabricated from a rigid material such as, for example, a metallic material, individual cubes may be removed utilizing the aforementioned biasing of the ice cube staffs. Metallic trays may also be gently warmed utilizing, for example, warm water, so as to facilitate the release of individual or all of the ice cubes therewithin.

It is highly advantageous to fabricate the flag staff of a relatively rigid material having high shear strength so as to enable the staff, as discussed below, to be utilized to bias frozen ice from an ice cube compartment. For this reason, and the fact that the staff is placed in water, make it highly advantageous to utilize hygienic and corrosion resistant materials such as, for example, stainless steel, aluminum, brass or precious materials. In the alternative, reinforced plastic materials, such as composite plastics, may also be utilized.

The decorative flag may be described as be comprised of a flag staff portion and a banner portion. The flag staff portion, as described above, is shaped and configured as a tapered rod including a superior and inferior terminus. The banner is affixed adjacent to the superior terminus thereof and a portion of the inferior terminus engages and affixes the decorative flag centrally within each compartment.

The decorative flag may be fabricated in a "two piece" arrangement wherein a separate and removable banner and staff are provided. In such embodiments, the banner portion includes a banner and short mast. In other embodiments, both banner and staff are integral and comprise a one piece decorative flag embodiment. In embodiments of the present invention which include the aforementioned two piece decorative flag, the banner is mounted upon a short mast. In such embodiments, the flag staff includes an opening at the superior terminus thereof contiguous with a central bore therewithin which is especially configured and adapted to mate with and engage an inferior terminus of the short mast so as to enable mounting of the banner thereupon. Such embodiments enable one to interchange decorative banners with a given staff. In one piece decorative flag embodiments of the present invention, the banners are fixed to the staff.

Regardless of decorative flag configuration, an inferior portion of the staff, adjacent its inferior terminus, is especially configured and shaped so as to fit snugly within a central bore of the retaining collar. The banner portion of the decorative flag may be configured in any desired shape such as, for example, a flag. It is most advantageous to place indicia and other decorative and/or informative marking upon the banner portion such as, for example, corporation logos, holiday greetings, national flags and any other desired markings and/or art. The banners are thus advantageously fabricated from any non-toxic material upon which such logos and other decorative markings may be made. For example, the banners may be fabricated from plastic, paper, or plastic coated paper materials, When released from the ice tray and, for example, place in an ice bowl, ice chest, ice bucket or other serving means, the afore-mentioned ice cube staff and decorative flag remain in the individual cubes. The ice cube staff and flag serve as a convenient, secure and hygienic means of removing the ice from a serving container and transporting the ice to, for example, a glass or cup containing (or which will contain) a beverage. The staff and flag can also, of course, be utilized to remove an individual cube from the tray and transport same directly to a cup, glass or other point of use.

Because of the tapered shape of the ice cube staff, upon bringing the ice cube to a position over ones cup or glass, the staff can be biased completely out of the cube by simply grasping the exposed portion of the staff between, for example, two fingers, and thereafter exerting a downward force against the top of the cube. However, one may also choose to remove only the decorative flag from the cube by grasping the banner portion thereof and biasing downward against the ice cube staff to release the flag portion only.

DETAILED DESCRIPTION

Figure 1:
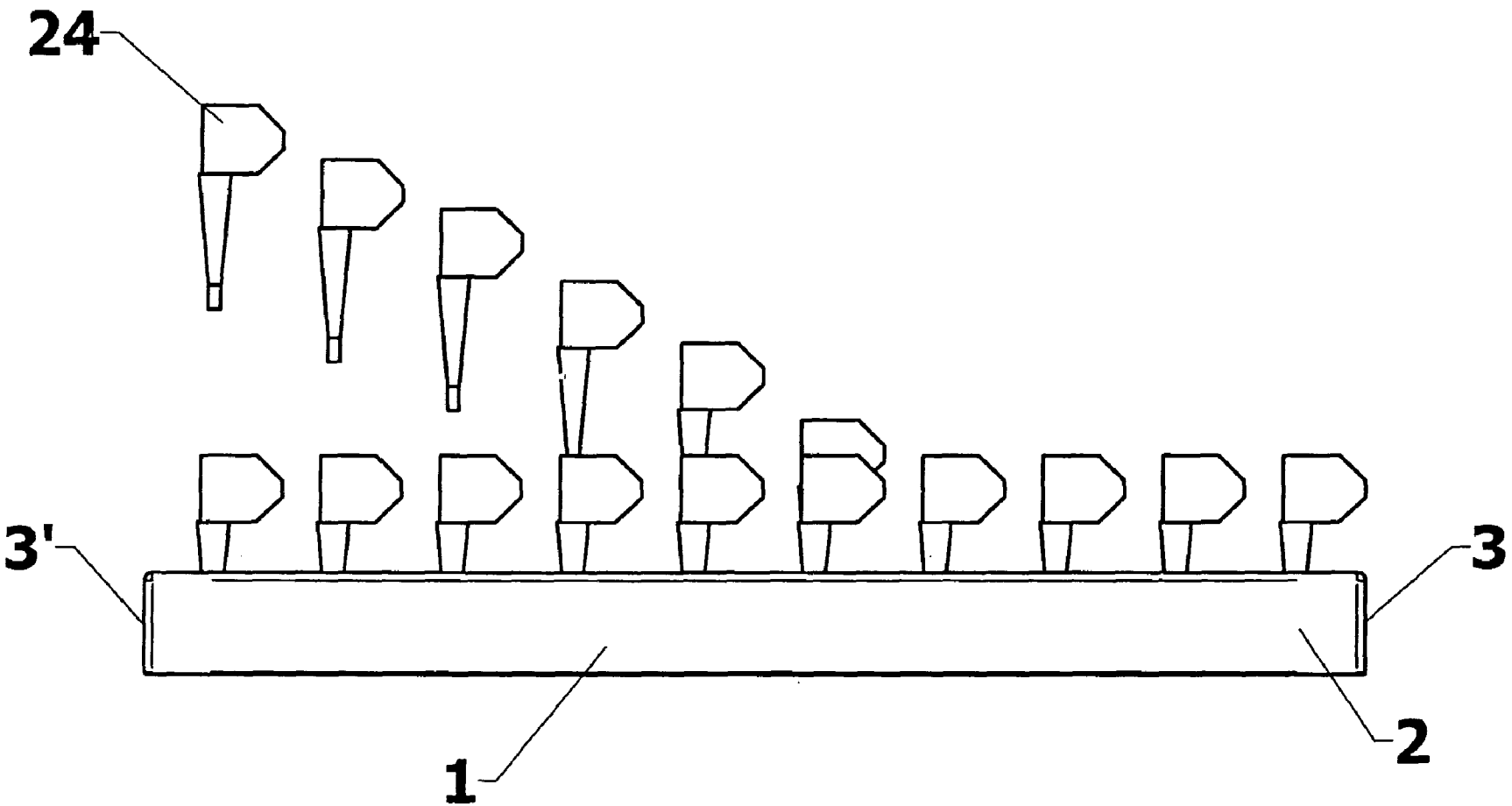
FIG. 1 is a front view of the tray, ice cube staff and decorative flag of an example of the first preferred embodiment.
Figure 2:
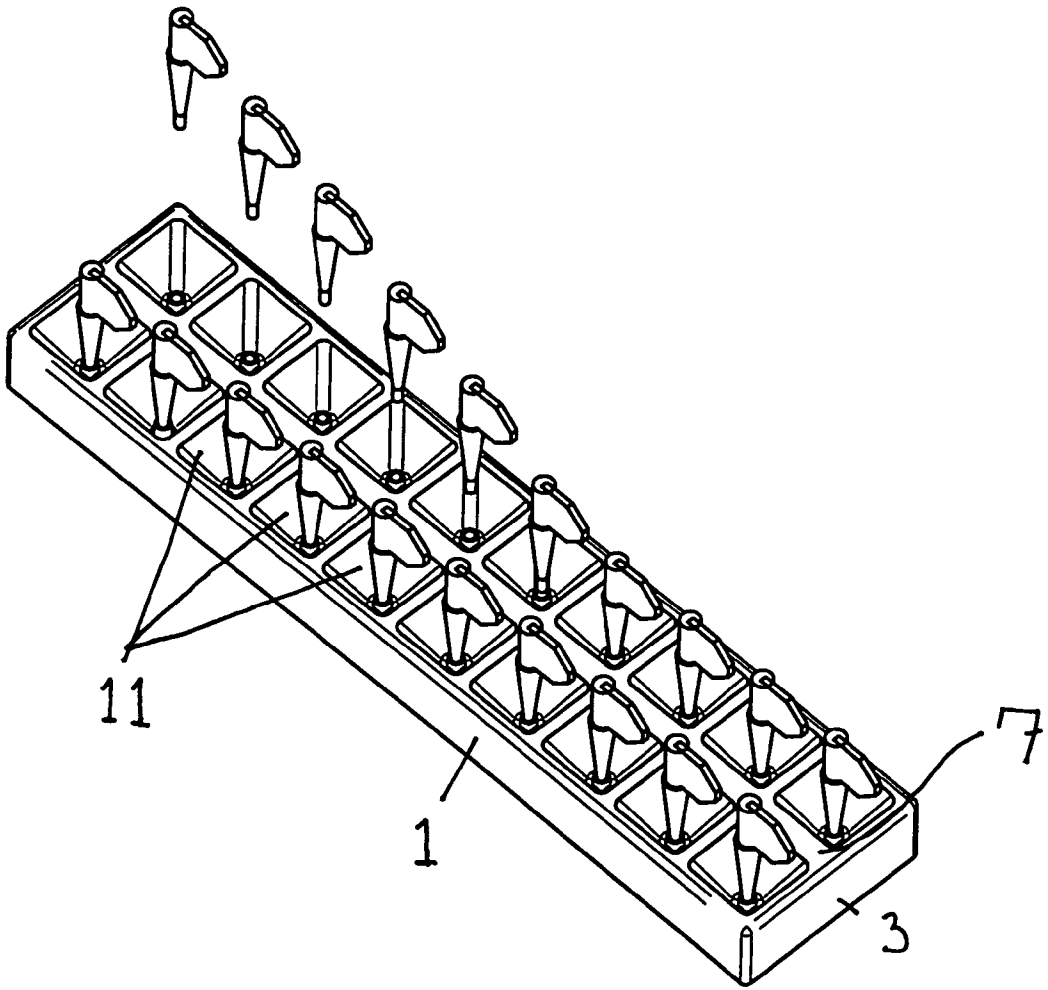
FIG. 2 is a right elevated isometric view of the example first embodiment illustrated in FIG. 1.
Figure 3:
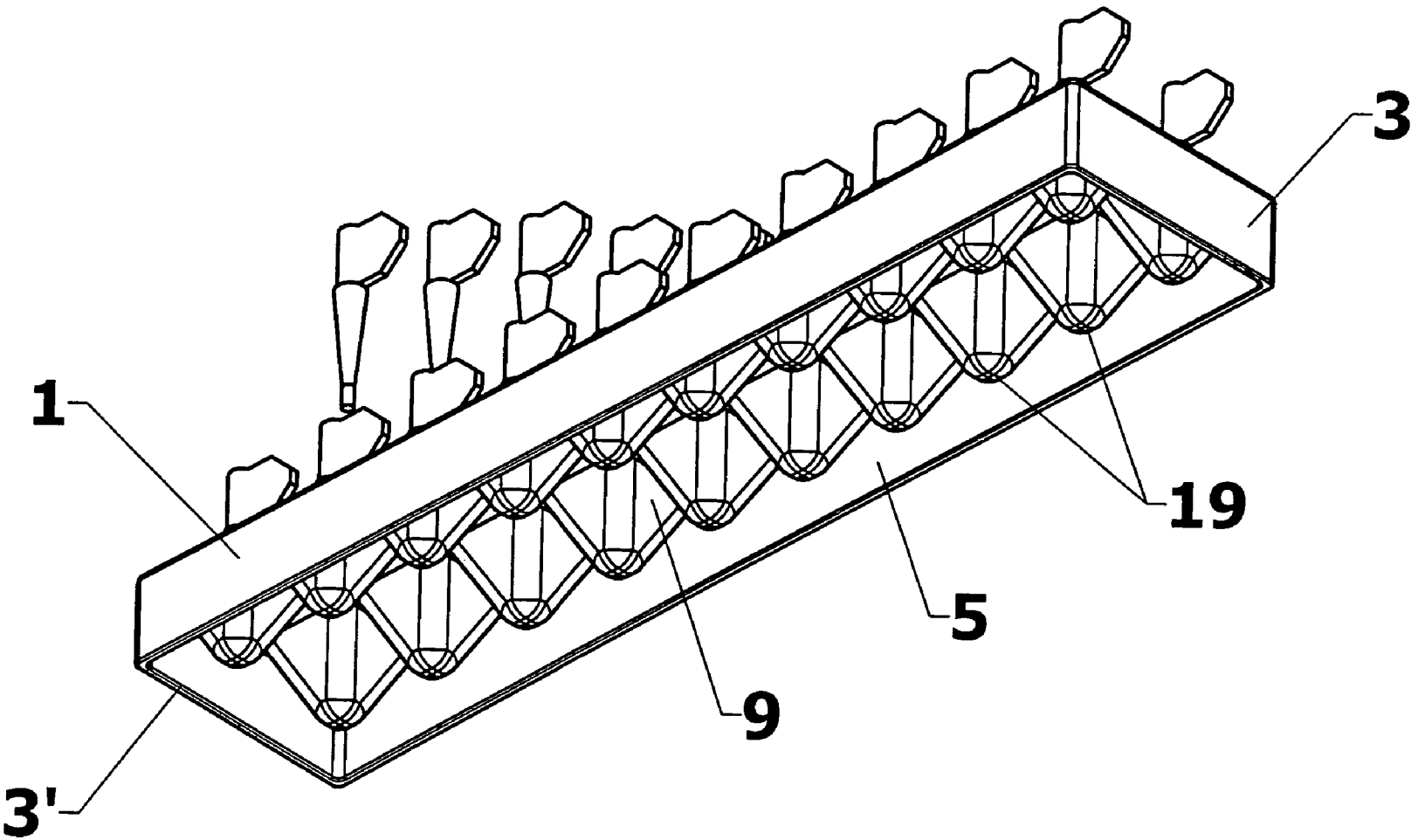
FIG. 3 is a right inferior isometric view of the example of the first embodiment illustrated in FIGS. 1 and 2.
Figure 4:
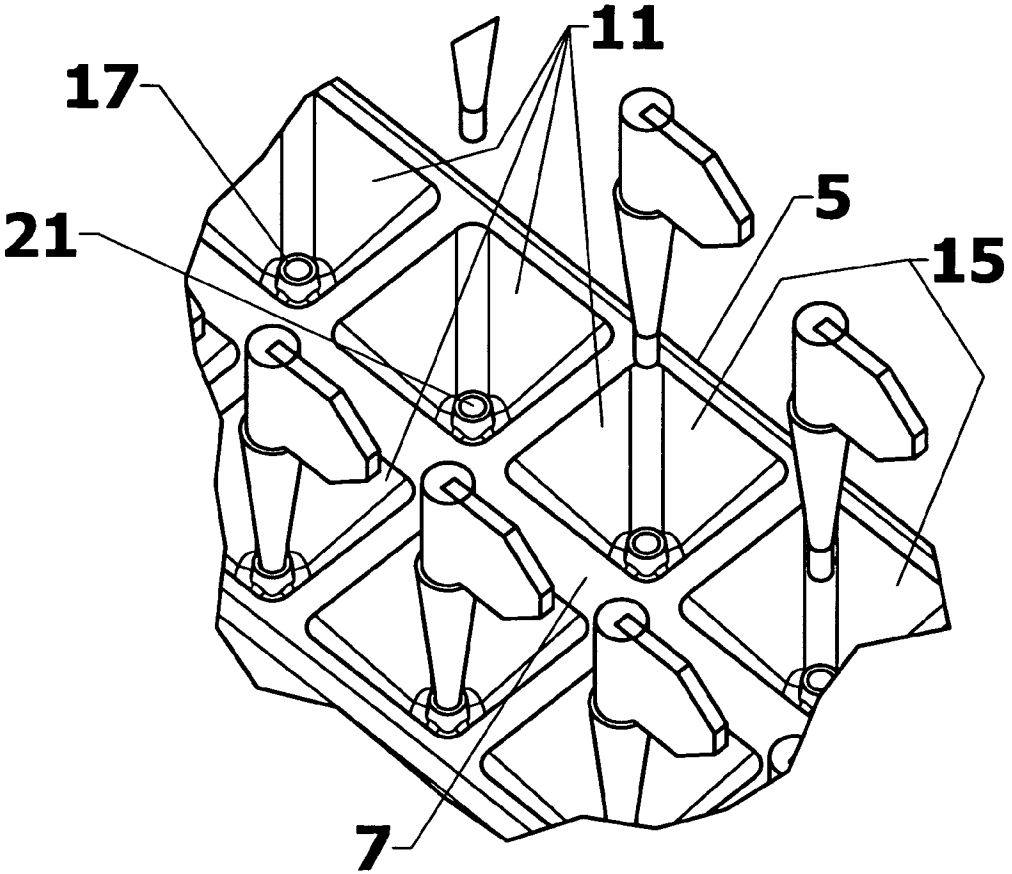
FIG. 4 is a detailed view of a portion of the example of the first embodiment illustrated in FIG. 2.
Figure 5:
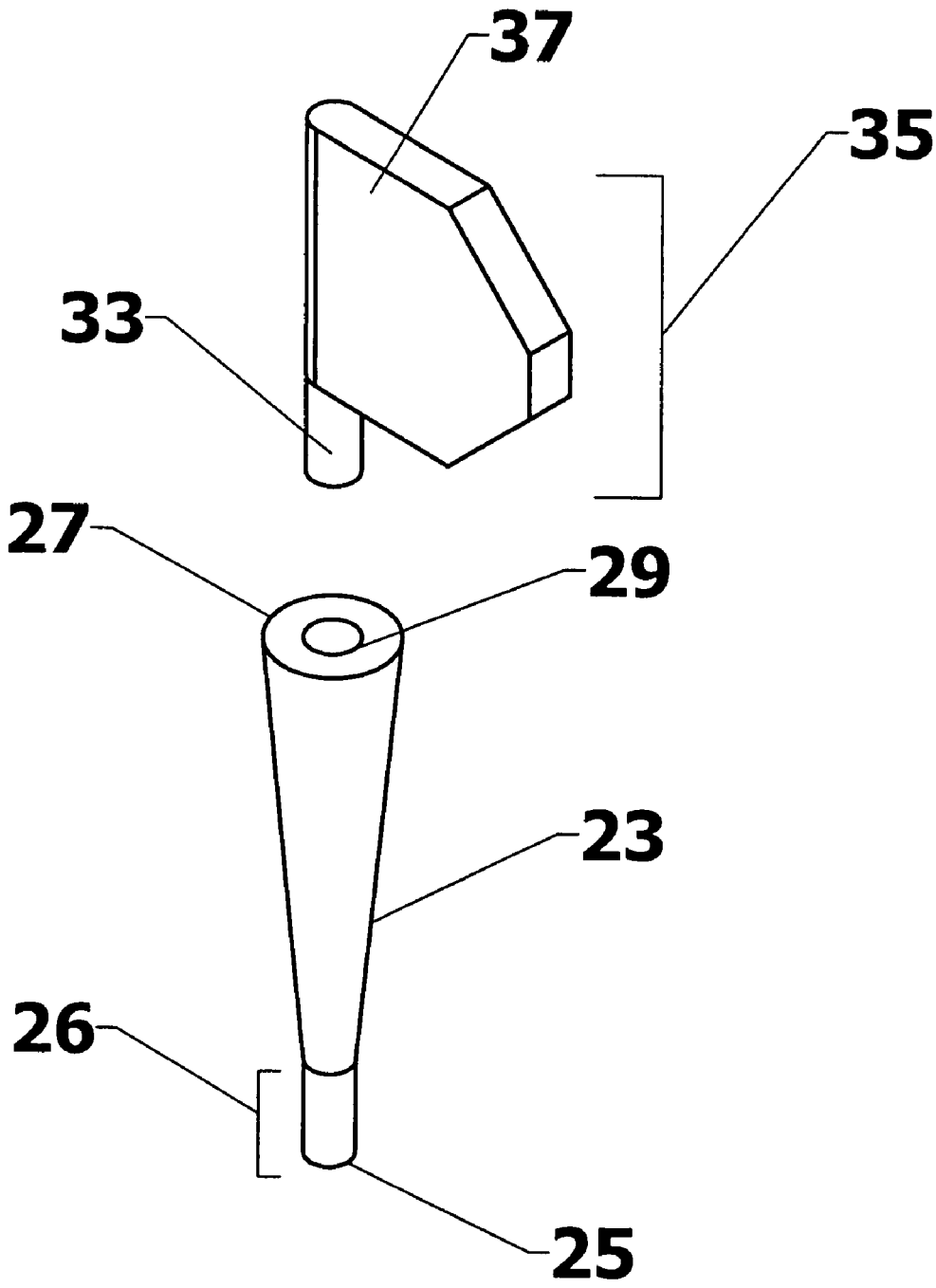
FIG. 5 is a detailed view of a two piece decorative flag of the present invention.
Figure 6:
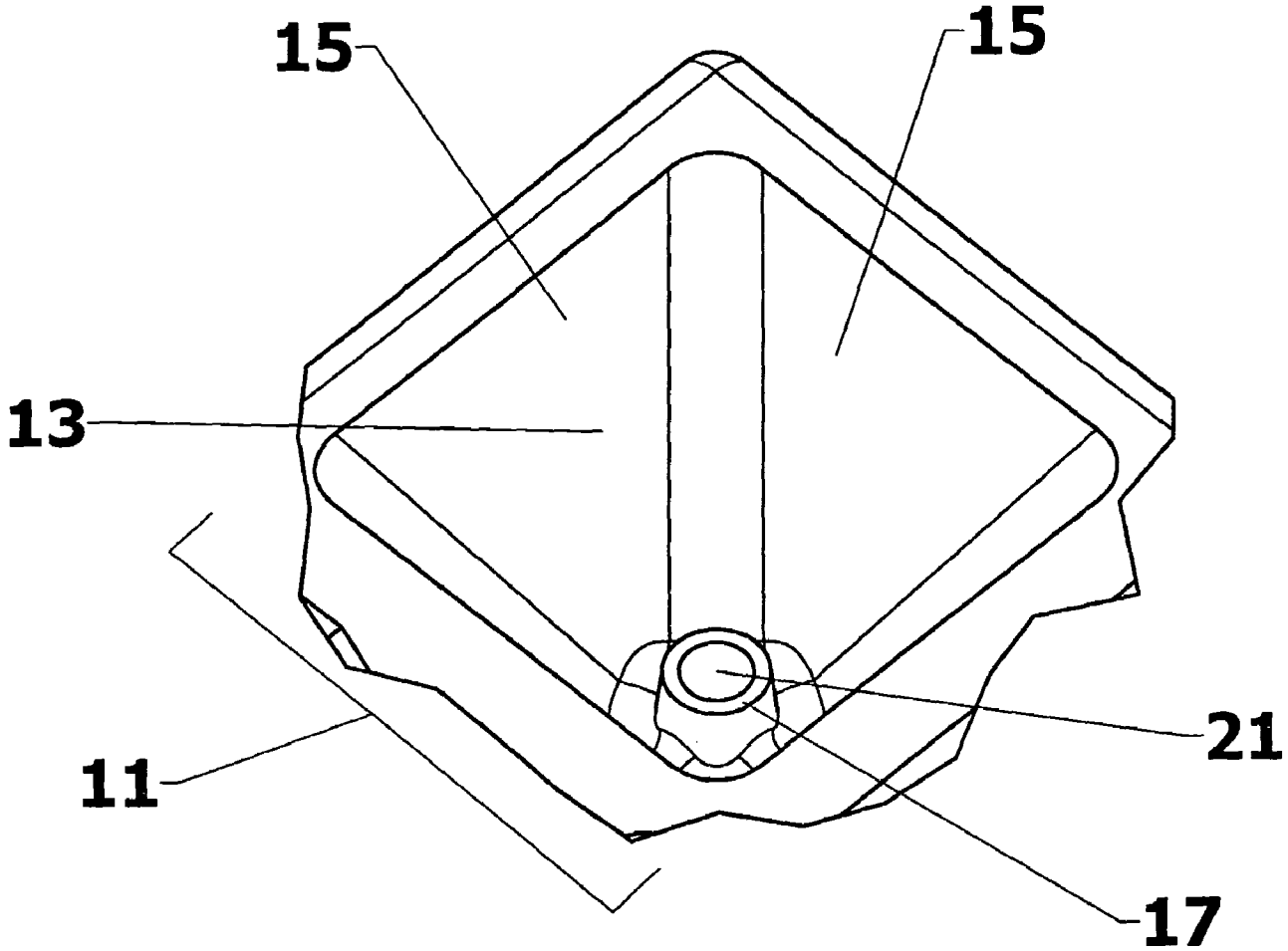
FIG. 6 is an additional detailed view of a portion of the example of the first embodiment of the present invention illustrated in FIG. 2.

FIG. 1-FIG. 6 illustrate the first embodiment of the present invention wherein the ice cube tray 2 is configured, for example, as a rectangular tray having a front wall 1, two end walls 3 & 3', a rear wall 5 a top portion 7 and a bottom portion 9. The top portion of the tray—as is true for all embodiments herein—is configured so as to form therein and thereof a plurality of compartments 11 which are open at a top portion 13 only, and otherwise closed so as to enable the compartments to contain water (as explained in more detail, below). As discussed above, the compartments may be configured in any desired shape such as, for example, a standard "cube" shape. However, the compartments may also be configured in more unusual and decorative shapes such as, for example, pyramidal shapes as illustrated in the figures herein. Regardless of the shape selected the compartments must be configured so as to avoid the inclusion of undercuts which would, of course, prevent frozen ice from being removed therefrom after water had frozen therewithin. More specifically, the 15 sidewalls of such compartments must either be roughly parallel or diverge from one another as they approach the top of the tray so that ice cubes formed therein will draw from the compartments. If, for example, the compartments are configured in a pyramidal shape (as illustrated in the figures), the apex of the pyramid must be located downward and at the lowest point of the compartment, pointing away from the top portion of the ice tray.

The compartments 11 are especially configured and formed to include a staff retaining collar 17. The collar is advantageously positioned, at the most inferior portion 19 of the compartment, and in a central location so that the central bore 21 formed therein faces upward. For example, if, as illustrated in the figures, a pyramidal shaped compartment is utilized, the retaining collar will be located at the apex thereof since such would be the central point of the most inferior portion of the compartment. If, on the other hand, the compartment is configured as a square cuboid shaped receptacle, then the retaining collar would be located in the center of the square shaped wall forming the inferior terminus of the compartment. The retaining collar is formed within and upon the surface of the compartments so as to be water tight and to couple with and securely engage the ice cube staff. The retainer collar is so located and configured so as to enable, as described below, secure and centralized positioning of the staff prior and after filling of the ice tray with water and so that, upon formation of each cube, the staff will be positioned centrally therewithin. For this purpose, the retaining collar defines the aforementioned central bore 21 into which an inferior portion 26 of the below described flag staff 23 is inserted.

The ice cube tray 1 may be advantageously fabricated from a relatively flexible material enabling the tray to be manually deformed (as discussed below), as a means of removing frozen ice therefrom. Such deformable, or, as it may also be referred to as—flexible material—includes, for example, polyacrylic, polycarbonate, polyester, polynitrile, polypropylene, polystyrene, polyvinyl plastics. The tray may also be advantageously fabricated from other flexible materials such as, for example, natural rubber compounds, polyurethane rubber, silicone rubber as well as other synthetic rubbers.

The ice cube staff 23 is advantageously shaped and configured as a tapered rod having an inferior 25 and superior 27 terminus. The staff is configured so that the diameter thereof increases from a minimal diameter adjacent to the inferior terminus thereof to a maximum diameter adjacent to the superior terminus thereof. However, and as shown in the figures and discussed in detail, above, in certain preferred embodiments of the present invention, the inferior portion 26 of the staff, which mates within the central bore of the collar may be shaped and configured as a straight rod—without taper in that portion of the staff—. The inferior terminus of the staff is closed and especially shaped and configured to enable coaxial insertion thereof within the central bore 21 of the above described retaining collar. When inserted into said bore, the staff is thereby located centrally, within the confines of the compartment in which it is placed. The staff is also selected to include a length sufficient to enable at least 25, and, more preferably, at least 40 percent of the length of said staff to extend beyond the top surface of the ice tray. By providing such a length and extension, it is assured that the banner portion of the decorative flag will extend well beyond the surface of ice which is formed within the compartment and also that there will be a sufficient length of staff to assist biasing the ice from the compartment as well as handling thereof after the release of the ice from the tray. In certain preferred embodiments of the present invention utilizing a two piece decorative flag, (as shown in the figures) the superior terminus of the staff, is open and, exposes a central bore 29 therewithin especially shaped and configured to firmly engage a short mast portion 33 affixed to the banner portion 35 of the decorative flag 37 and thus retains the mast and attached banner within the staff. In other preferred embodiments of the present invention, the banner and staff are formed as one piece with the banner affixed adjacent to the superior portion of the staff by any effective means such as, for example, bonding, adhesive compounds, or forming the banner so that it tightly fits about that portion of the staff. Utilizing the two piece design wherein the staff can be detached from the banner and mast enables one to utilize an assortment of banners with a given staff. In regard to the two piece decorative flag embodiment illustrated herein, the banner may also be affixed to the short mast by similar means as described above in regard to the one piece decorative flag embodiment.

As described above, the flag staff is fitted within and engages the cental bore of the retaining collar of an ice cube compartment—preferably with a water-tight fit—prior to filling same with water. A water tight fit between the staff and central bore of the collar assures that water will not fill a space left between the staff and bore walls so as to freeze—and therefore affix—the staff to the compartment. As described above, the compartments are filled with water and the tray is placed in a freezer, for example, in order to enable the water therein to freeze into cubes. When the water has thoroughly frozen, the ice cubes may be individually removed from the tray by applying a lateral, biasing force to that portion of the staff which extends from the top of each ice cube desired. However, one may also remove the ice cubes from the tray via the conventional means. For example, in embodiments of the present invention wherein the trays are formed of a flexible plastic material, the tray may be twisted so as to release the cubes. A tapping force may also be utilized, with or without the use of warm water to gently warm the bottom of the tray.

If the tray is fabricated from a rigid material such as, for example, a metallic material, individual cubes may be removed utilizing the aforementioned biasing of the ice cube staffs. Metallic trays may also be gently warmed utilizing, for example, warm water, so as to facilitate the release of individual or all of the ice cubes therewithin.

It is highly advantageous to fabricate the flag staff of a relatively rigid material having high shear strength so as to enable the staff, as discussed below, to be utilized to bias frozen ice from an ice cube compartment. For this reason, and the fact that the staff is placed in water, make it highly advantageous to utilize corrosion resistant metallic materials such as, for example, stainless steel, brass or precious metal materials such as, for example, gold, silver and platinum metals—including gold, silver and platinum plated metal materials. In the alternative, reinforced plastic materials, such as composite plastics, may also be utilized.

The decorative flag is comprised of a flag staff portion 23 and a banner portion 35. In the aforementioned embodiment wherein the staff can be removed from the banner, the decorative flag is described as being comprised of a flag staff, short mast and banner portion. The flag staff portion includes a superior and inferior terminus. The staff is shaped and configured as a tapered rod demonstrating its most minimal diameter proximal to the inferior terminus 25 thereof and its greatest diameter proximal to the superior terminus 27 thereof. The staff is especially configured and shaped so as to fit snugly within the bore of the retaining collar. The banner portion of the decorative flag may be configured in any desired shape such as, for example, a flag. It is most advantageous to place indicia and other decorative marking upon the banner portion such as, for example, corporation logos, holiday greetings, national flags and any other desired markings and/or art. The banners are thus advantageously fabricated from any non-toxic material upon which such logos and other decorative markings may be made. For example, the banners may be fabricated from plastic, paper, or plastic coated paper materials, When released from the ice tray and, for example, place in an ice bowl, ice chest, ice bucket or other serving means, the afore-mentioned ice cube staff and decorative flag remain in the individual cubes. The ice cube staff and flag serve as a convenient, secure and hygienic means of removing the ice from a serving container and transporting the ice to, for example, a glass or cup containing (or which will contain) a beverage. The staff and flag can also, of course, be utilized to remove an individual cube from the tray and transport same directly to a cup, glass or other point of use.

The terms and expressions which have been employed in the foregoing specification are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. An ice cube handling device comprised of an ice cube tray and decorative flag wherein the ice cube tray includes a top portion, a bottom portion and sidewalls and wherein the top portion of the tray is configured and shaped so as to form a plurality of compartments therein which are open at a superior terminus only and capable of containing water therewithin, the compartments including, at a central point of a most inferior portion thereof, a flag staff retaining collar having a central bore therewithin which said bore is continuous with an opening located at a superior terminus of the collar; and the decorative flag includes a banner and a staff wherein the staff is shaped and configured as a tapered rod having a diameter, a length, a superior and an inferior terminus, wherein the diameter of said staff is greatest adjacent the superior terminus thereof and most diminutive adjacent the inferior terminus thereof, the banner being affixed to said staff at a portion of the staff adjacent to the superior terminus thereof, wherein an inferior portion of the staff adjacent the inferior terminus thereof and the central bore of the retaining collar are especially shaped and configured so as to enable said inferior portion of the staff to enter and firmly engage the central bore of the collar thereby affixing the decorative flag centrally within said compartment in such a manner that the banner and a portion of the staff extend beyond the superior terminus of said compartments and ice which is formed therein.

2. The ice cube handling device of claim 1, wherein the decorative flag is comprised of a staff section and a banner section comprising two individual and separable components together forming the decorative flag, the staff section being formed as a tapered rod having an inferior and superior terminus, said superior terminus of the staff section including an opening contiguous with a central bore located within said staff section; and wherein the banner section is comprised of mast upon which a banner is affixed, the mast being configured as a tapered rod having a superior and an inferior terminus, wherein the mast is especially shaped and configured so as to enable coaxial insertion of an inferior portion of the mast, adjacent to the inferior terminus thereof into the opening located at the superior terminus of the flag staff, thereby enabling the banner section to be releaseably mounted upon said staff section.

3. The ice cube handling device of claim 1, wherein the tray is formed of a flexible material.

4. The ice cube handling device of claim 3, wherein the flexible material is selected from the group consisting of plastic and rubber materials.

5. The ice cube handling device of claim 4, wherein the plastic material is selected from the group consisting of polyacrylic, polycarbonate, polyester, polynitrile, polypropylene, polystyrene, and polyvinyl plastics.

6. The ice cube handling device of claim 3, wherein the flexible material is a rubber material.

7. The ice cube handling device of claim 6, wherein the rubber material is selected from the group consisting of natural and synthetic rubber materials.

8. The ice cube handling device of claim 7, wherein the synthetic rubber material is selected from the group consisting of silicone and polyurethane rubber materials.

9. The ice cube handling device of claim 1, wherein the tray is formed of an a rigid material.

10. The ice cube handling device of claim 9, wherein the rigid material is a metallic material.

11. The ice cube handling device of claim 10, wherein the metallic material is selected from the group consisting of stainless steel, aluminum and brass.

12. The ice cube handling device of claim 1, wherein the flag staff is fabricated from a metallic material.

13. The ice cube handling device of claim 12, wherein the metallic material is selected from the group consisting of aluminum, brass, stainless steel and precious metals.

14. The ice cube handling device of claim 1, wherein the flag staff is fabricated from a reinforced plastic material.

15. The ice cube handling device of claim 1, wherein the flag staff is fabricated from a composite plastic material.

* * * * *